United States Patent [19]

Sumitomo et al.

[11] 4,347,897

[45] Sep. 7, 1982

[54] PLATE TYPE HEAT EXCHANGER

[75] Inventors: Hiroyuki Sumitomo, Amagasaki; Haruo Uehara, Saga, both of Japan

[73] Assignee: Hisaka Works, Ltd., Osaka, Japan

[21] Appl. No.: 94,831

[22] Filed: Nov. 16, 1979

Related U.S. Application Data

[63] Continuation of Ser. No. 868,749, Jan. 12, 1978, abandoned.

[30] Foreign Application Priority Data

Jan. 19, 1977 [JP] Japan ..... 52-5270
Jan. 19, 1977 [JP] Japan ..... 52-5271
Jan. 28, 1977 [JP] Japan ..... 52-9029

[51] Int. Cl.[3] ..... F28F 3/00; B01D 1/00
[52] U.S. Cl. ..... 165/167; 159/28 P
[58] Field of Search ..... 165/166, 167; 159/28 P

[56] References Cited

U.S. PATENT DOCUMENTS 2,616,671 11/1952 Wakeman ..... 165/167
3,562,116 2/1971 Rodgers ..... 159/13 R
3,631,923 1/1972 Izeki ..... 165/167
3,735,793 5/1973 Burberry et al. ..... 159/13 R X
3,840,070 10/1974 Becker et al. ..... 165/167
3,984,281 10/1976 Buchwald ..... 165/167 X
4,156,459 5/1979 Kusuda et al. ..... 165/167
4,182,411 1/1980 Sumitomo et al. ..... 165/166 X

FOREIGN PATENT DOCUMENTS 1421915 1/1976 United Kingdom ..... 159/28 P

*Primary Examiner*—Samuel Scott
*Assistant Examiner*—Theophil W. Streule, Jr.
*Attorney, Agent, or Firm*—Armstrong, Nikaido, Marmelstein & Kubovcik

[57] ABSTRACT

A plate type heat exchanger arranged so that heat exchange is effected between fluids through heat transfer plates. It comprises heat transfer plates serving as heat transfer elements, and jet plates each having a number of small holes. One fluid is jetted through the small holes in the jet plates towards the heat transfer plates opposed to the jet plates while the other fluid flows along the respective opposite heat transfer surfaces of the heat-transfer plates or is jetted toward the respective opposite heat transfer surfaces as in the case of the first fluid.

5 Claims, 6 Drawing Figures

PLATE TYPE HEAT EXCHANGER

This is a continuation of application Ser. No. 868,749, filed Jan. 12, 1978, now abandoned.

BACKGROUND OF THE INVENTION (a) Field of the Invention:

This invention relates to a plate type heat exchanger and more particularly it relates to a plate type heat exchanger referred to as a collision-jet type plate heat exchanger.

(b) Description of the Prior Art:

Generally, the plate type heat exchanger effects heat exchange between two fluids flowing along heat transfer plates and a conventional plate type heat exchanger has disadvantages. Because of the construction in which a complex pattern is formed on the heat transfer surface to disturb the flow of fluid in order to obtain a high thermal conductivity, it cannot be helped to suffer a considerable pressure loss. Therefore, in an actual design aspect, it sometimes happens that a high thermal conductivity cannot be attained because of the need of reducing the pressure loss. Further, in the case of highly viscous fluids, such fluid often fails to reach the regions in the heat transfer surfaces farther from the fluid inlet and outlet ports. This means that the deviated flow of fluid takes place on the heat transfer surfaces, so that high heat transfer performance cannot be obtained. Further, prolonged use results in the heat transfer surfaces being fouled, thus leading to substantial deterioration in the performance.

When consideration is given to a conventional heat exchanger in which the two fluids are steam and a cooling liquid and heat exchange therebetween results in the steam being condensed, i.e., a conventional condenser, it is seen that the conventional plate type condenser has disadvantages. That is, since the form of condensation of steam which takes place on the heat transfer surfaces is film-form condensation, it is impossible to attain a very high thermal conductivity. The flow of steam is influenced by the condensed condition on the heat transfer surfaces and the deviated flow and the like are liable to take place. Besides this, a very small amount of uncondensable gas contained in the steam stagnates on the heat transfer surfaces, hindering the improvement of the overall coefficient of heat transfer.

SUMMARY OF THE INVENTION

An object of the present invention is to provide a so-called collision-jet type plate heat exchanger comprising heat transfer plates serving as heat transfer elements, and jet plates each having a number of small holes.

According to a feature of the present invention, in such arrangement, one fluid is jetted through the small holes in the jet plates to collide against the heat transfer plates opposed to the jet plates. The other fluid flows along the respective opposite heat transfer surfaces of the heat transfer plates or is jetted toward said respective opposite heat transfer surfaces of the heat transfer plates as in the case of the first fluid. Therefore, the following advantages are observed.

The fluid pressure loss is limited to the pressure loss caused by the fluid being jetted through the small holes. Since the flow of fluid is a jet and the small holes can be formed to correspond to any desired positions on the heat transfer surfaces, the deviated flow of fluid can be avoided. Since the fluids are jetted for collision always at a fixed rate of flow, a high stabilized thermal conductivity can be attained. Further, the collision of the jet flow against the heat transfer surfaces produces the action of cleaning the heat transfer surfaces, thereby preventing the deterioration of heat transfer performance due to fouling.

This type of heat transfer using such colliding jet flow assures a high thermal conductivity in that the film thickness is reduced by sharp changes in the direction of flow of fluid. In this connection, it should be noted that when jet flow is caused to collide against a vertical flat plate, the effective region for heat transfer is limited to the upper region of the heat transfer surface since in the other regions the after-jet streams flowing down from above forms a downflow film on the heat transfer surface which becomes thicker as it approaches the bottom region, so that a high thermal conductivity cannot be obtained. As a result, the thermal conductivity as a whole is liable to be held low. Accordingly, another feature of the invention is that drain means is provided on the heat transfer surfaces for collecting the after-jet streams and discharging it out of the heat transfer surfaces.

If the invention is applied to condensation, the following merits are obtained.

Since the steam is blown against the heat transfer surfaces at a relatively high rate of flow, the condensate is blown off by the dynamic pressure of the steam while it is dispersed in drips by the action of surface tension, presenting quasi-drip-like condensation or at least very thin film-like condensation, with the result that many nakid areas are secured on each heat transfer surface to achieve high condensation heat transfer. Further, since the small holes can be arranged so that the steam may be jetted to any desired positions on the heat transfer surfaces, to worry about the deviated flow of steam is eliminated. Since a predetermined rate of steam can be maintained at all positions on the heat transfer surfaces, it is possible to prevent the uncondensable gas from stagnating on the heat transfer surfaces, minimizing the adverse effects thereof.

These and other objects and features of the invention will become more apparent from the following description with reference to the accompanying drawings.

DESCRIPTION OF THE PREFERRED EMBODIMENTS

Figure 1:
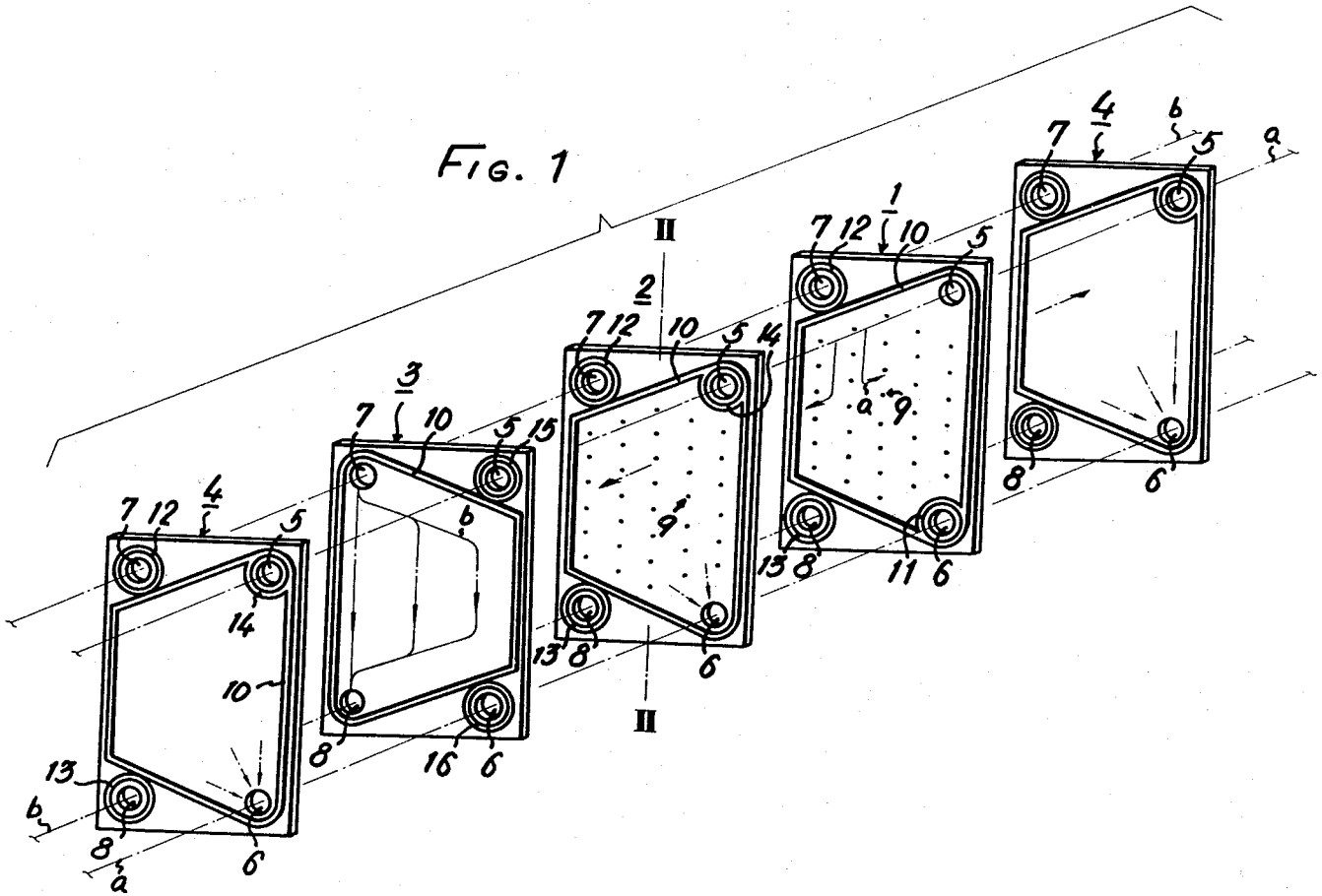
FIG. 1 is an exploded perspective view of a group of plates constituting a collision-jet type plate heat exchanger according to the invention.
Figure 2:
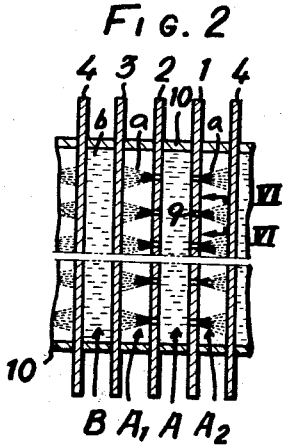
FIG. 2 is a sectional view taken along the line II—II of FIG. 1, showing the plates in their assembled condition.

FIGS. 1 and 2 illustrate a basic embodiment of the present invention, wherein 1 and 2 designate jet plates and 3 and 4 designate heat transfer plates. These plates are put together in the illustrated order, defining therebetween a channel A to which a first fluid is supplied, channels A1 and A2 into which said first fluid is jetted, and a channel B to which a second fluid is supplied. Each plate has four ports at the four corners. Of these ports, the ports 5 provide an inlet passageway for the first fluid and the ports 6 provide an outlet passageway for the first fluid while the ports 7 provide an inlet passageway for the second fluid and the ports 8 provide an outlet passageway for the second fluid.

The jet plate 1 is opposed to the other jet plate 2 to define the channel A for the supply of the first fluid, said supply channel A being also defined by an associated gasket 10 in a clearance defined between the plates. More specifically, the gasket 10 is disposed to surround the middle region of the plate and the inlet port 5 for the first fluid. The jet plates 1 and 2 each have a number of small holes 9 through which the first fluid is jetted. Therefore, the supply channel A for the first fluid is in communication with the first fluid inlet ports 5 and small holes 9. The first fluid outlet port 6 and the second fluid ports 7 and 8 are isolated from the outside by gaskets 11, 12 and 13, respectively.

The jet plate 2 is opposed to the jet plate 2 and the first fluid jet channel A1 is defined by an associated gasket 10 disposed to surround the heat transfer region of the heat transfer plate 3 and the first fluid outlet port 6. Therefore, it is in communication with the first fluid outlet port 6 and small holes 9. The first fluid inlet port 6 and the second fluid ports 7 and 8 are isolated from the outside by gaskets 14, 12 and 13, respectively.

The heat transfer plate 3 is adjacent and opposed to another heat transfer plate 4 to define the second fluid supply channel B therebetween. The supply channel B is defined by an associated gasket 10 disposed to surround the heat transfer region of the heat transfer plates 3 and 4 and the second fluid ports 7 and 8. Therefore, it is in communication with only these ports 7 and 8. The first fluid ports 5 and 6 are isolated from the outside by gaskets 15 and 16, respectively. The heat transfer plate 4 is opposed to a subsequent jet plate to define the first fluid jet channel A2 which is in communication with only the first fluid outlet ports 6, as in the case of the jet channel A1 described above.

How the first and second fluids flow is as shown in dash-dot lines in FIGS. 1 and 2. The operation of the collision-jet type plate heat exchanger of the present invention will now be described according to the flow of the fluids.

The first fluid a is supplied through the first aligned fluid inlet ports 5 and flows into the individual first fluid supply channels A, from which it is jetted into the neighboring jet channels A1 and A2 through the small holes 9 in the jet plates 1 and 2. The jets from the small holes 9 collide against the heat transfer surfaces of the heat transfer plates 3 and 4 opposed to the jet plates 1 and 2. Thereafter, it becomes the after-jet streams flows downwardly along the heat transfer surfaces toward the lower outlet ports 6. On the other hand, the second fluid b is supplied through the second fluid inlet ports 7 and flows into the second fluid supply channel B, and when it flows downwardly inside the channel B toward the outlet port 8, heat exchange with the first fluid a in the neighboring jet channels A1 and A2 is effected through the heat transfer plates 3 and 4.

Figure 4:
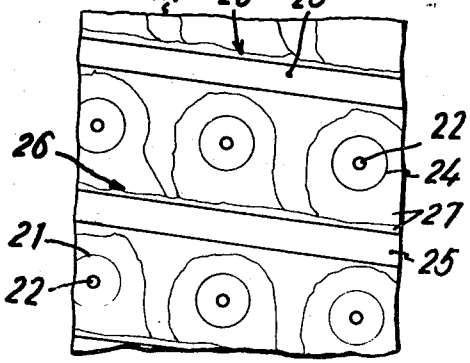
FIG. 4 is a front view of the principal portion of a jet plates, as viewed from the line IV—IV of FIG. 3.
Figure 3:
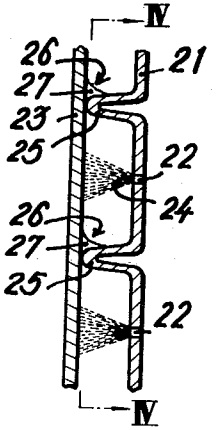
FIG. 3 is a side view, in longitudinal section, similar to FIG. 2, showing an embodiment wherein there is provided means for collecting and discharging the after-jet stream from a heat transfer surface.

FIGS. 3 and 4 illustrate another embodiment of the invention, wherein the numeral 21 designates a jet plate formed with a number of small holes 22; 23 designates a heat transfer plate having flat heat transfer surfaces; and 24 designates jets of the fluid being jetted from the small holes 22. The jet plate 21 is formed on one side thereof with projections 25 extending toward the heat transfer plate 23 and running obliquely on the plate surface. The projections 25 are of a band form in a plan view and either press-shaped integrally with the jet plate 21 or formed by fixing separate members to the plate 21. As a result of the plates being put together, the projections 25 have their front ends bought into abutment against the heat transfer surface of the heat transfer plate 23 which is adjacent and opposed thereto, thereby constituting water discharge groove means 26.

The water discharge groove means 26 serves to collect after-jet streams 27 which are produced after the jets from the small holes 22 in the jet plate 21 collide against the heat transfer surface of the heat transfer plate 23, and causes said after-jet streams to be effectively move downwardly along the projections 25 for discharge. Thus, there is formed no downflow film because of the after-jet streams flowing downwardly from the upstream region of the heat transfer surface, so that the heat conductivity can be improved.

The projections 25, which are disposed one above another in parallel to each other, also effectively serve as reinforcing means for maintaining the clearance between the jet plate 21 and the heat transfer plate 23. Further, in the illustrated example, the projections 26 are provided on the jet plate 21, but they may be provided on the heat transfer plate 23. In this connection, however, it is to be noted that in a collision-jet type plate heat exchanger, since the jet plates do not directly take part in heat transfer between fluids, they do not need any special material and may be made of a material whose heat conductivity is low, such as plastics. For this reason, it is seen that it is more advantageous to provide said projections on the jet plate which can be made of a highly workable material.

Figure 5:
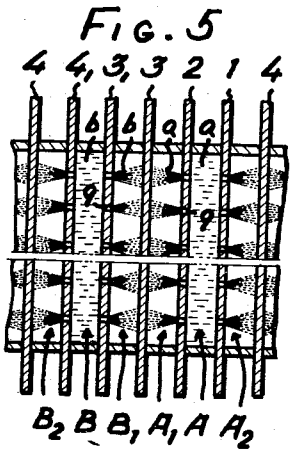
FIG. 5 is a side view, in longitudinal section, similar to FIG. 2, showing an embodiment arranged so that two fluids between which heat exchange is to be effected are both jetted.

In the embodiments described above, one of the fluids between which heat exchange is to be effected is jetted, but it is, of course, possible to jet both of them and such embodiment is shown in FIG. 5, which shows a section similar to FIG. 2, wherein the second fluid b, which, in FIG. 2 embodiment, simply flows through the supply channel B, is jetted, as in the case of the first fluid a, from the supply channel B defined by jet plates $3_1$ and $4_1$ through the small holes 9 in the jet plates $3_1$ and $4_1$ into the jet channel $B_1$ and $B_2$ to collide against the heat transfer surfaces of the heat transfer plates 3 and 4.

In deciding whether one or both of the fluids should be jetted, the following should be understood.

As for the overall coefficient of heat transfer which decides the perfoemance of heat exchangers, generally the lower one of the film coefficients of heat transfer for either the higher temperature or lower temperature fluid is a decisive factor. Therefore, by regarding that fluid for which the film coefficient is lower (in many cases, the film coefficient for gases is lower than that for liquids) as the first fluid, it is possible to expect a marked improvement of the performance as a whole.

Figure 6:
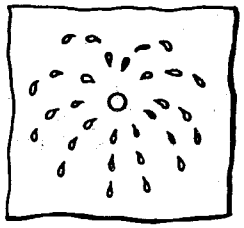
FIG. 6, is a view corresponding to what is viewed from the line VI—VI of FIG. 2, showing a form of condensation of steam obtained when a collision-jet type plate heat exchanger is applied to condensation of steam.

FIG. 6 shows how the steam condensates when a collision-jet type plate heat exchanger accoding to the present invention is applied to the condensation of steam. This will now be described with reference to FIG. 2.

The gas for which the film coefficient of heat transfer is taken as being lower, i.e., steam, is supplied to the supply channel A, from which it is jetted through the small holes 9 into the jet channels A1 and A2, moving toward the heat transfer plates 3 and 4. On the other hand, the cooling liquid is flowing through the supply channel B. The cooling liquid may, of course, be also jetted, as described in connection with the embodiment shown in FIG. 5.

As a result, heat exchange is effected between the steam and the cooling liquid through the heat transfer plates 3 and 4, with the steam condensing on the heat transfer surfaces of the heat transfer plates. It condenses into drips, as shown in FIG. 6, or at least very thin films. In other words, since the steam is blown against the heat transfer at a relatively high speed, the condensate is scattered by the dynamic pressure of the steam and dispersed in the form of drips by the action of surface tension. Therefore, many nakid areas not covered with films of condensate are secured on the heat transfer surfaces, so that the transfer of condensation heat is improved. As many apparently widely different embodiments of this invention may be made without departing from the spirit and scope thereof, it is to be understood that the invention is not limited to the specific embodiments thereof except as defined in the appended claims.

We claim:

1. A plate type heat exchanger for exchanging heat between first and second fluids, said heat exchanger comprising a plurality of plate assemblies, each assembly including a heat exchange plate to provide heat exchange between said first and second fluids while maintaining separation of said first and second fluids, at least one of said plate assemblies including jet plate means positioned adjacent and parallel to at least one of said heat exchange plates, said jet plate means including a plurality of hole means therethrough, said hole means being distributed on said jet plate means in a selected pattern, wherein said hole means are oriented with respect to said heat exchange plate such that fluid passes through said hole means in only one direction perpendicular to said at least one heat exchange plate only in the direction towards said heat exchange plate and contacts said at least one heat exchange plate.

2. A plate type heat exchanger as set forth in claim 1, wherein the two fluids are steam and a cooling liquid and the exchange of heat between them results in the steam being condensed.

3. A plate type heat exchanger as set forth in claim 1 wherein said at least one heat exchange plate is at least one pair of adjacent, parallel heat exchange plates, and wherein said first fluid flows through said jet plate means and contacts said pair of heat exchange plates and said second fluid flows between said pair of heat exchange plates.

4. A plate type heat exchanger as set forth in claim 1 wherein said jet plate means are positioned on either side of one of said at least one heat exchange plate and wherein said first fluid flows through said jet plate means on one side of said one heat exchange plate and said second fluid flows through said jet plate means on the other side of said heat exchange plate.

5. A plate type heat exchanger as set forth in claim 1 including projection means positioned between said at least one heat exchange plate and said jet plate means said projection means forming drain channels for collecting fluids which have passed through said hole means and contacted said heat exchange plate.

* * * * *